United States Patent [19]

Paravella et al.

[11] Patent Number: 4,998,857

[45] Date of Patent: Mar. 12, 1991

[54] STORAGE STRUCTURE FOR TEXTILE BOBBINS

[75] Inventors: Luciano Paravella, Pavia; Luigi Figini, Varedo, both of Italy

[73] Assignee: Snia Fibre spa, Milan, Italy

[21] Appl. No.: 393,857

[22] Filed: Aug. 15, 1989

[30] Foreign Application Priority Data

Nov. 29, 1985 [IT] Italy ..... 23023 A/85
Nov. 26, 1986 [WO] PCT Int'l Appl. ... PCT/EP86/00683

[51] Int. Cl.[5] ..... B65G 1/10

[52] U.S. Cl. ..... 414/331; 198/487.1; 198/803.12; 414/908; 414/911; 414/273; 414/21; 414/280; 414/661; 242/79; 211/1.5

[58] Field of Search ..... 242/79, 85; 414/331, 414/661, 273, 274, 277, 279, 280, 281, 282, 21, 911, 908, 910; 198/483.1, 803.12, 803.01, 375; 211/1.5

[56] References Cited

U.S. PATENT DOCUMENTS

| | | | |
|---|---|---|---|
| 3,024,887 | 3/1962 | Ingham, Jr. | 198/487.1 X |
| 3,780,852 | 12/1973 | Weiss et al. | 414/331 X |
| 3,924,762 | 12/1975 | Igel | 414/331 |
| 4,515,328 | 5/1985 | Payne, Jr. | 198/487.1 X |
| 4,641,740 | 2/1987 | Grecksch et al. | 198/487.1 E |
| 4,669,942 | 6/1987 | Nagasawa | 414/331 |
| 4,694,949 | 9/1987 | Nakagawa | 198/803.12 X |
| 4,718,560 | 1/1988 | Kiriake | 198/803.12 X |
| 4,783,021 | 11/1988 | Nagasawa | 414/331 X |

FOREIGN PATENT DOCUMENTS

| | | | |
|---|---|---|---|
| 202222 | 11/1983 | Japan | 414/331 |
| 212304 | 12/1984 | Japan | 414/331 |
| 93007 | 5/1985 | Japan | 414/331 |

*Primary Examiner*—Frank E. Werner
*Attorney, Agent, or Firm*—Wolf, Greenfield & Sacks

[57] ABSTRACT

The present invention concerns a storage structure for yarn bobbins and it comprises a plurality of storage units having support devices of the bobbin. Such storage units are distributed in a plurality of stationary deposit equipments. The storage units contained within each stationary deposit equipment are movable along an annular path. The stationary deposit equipments are vertically superimposed in groups. The groups of deposits are arranged in lateral, side-by-side relationship, thus defining a vertical surface of loading and a vertical surface of unloading, which are accessible from devices of loading and unloading, respectively.

18 Claims, 6 Drawing Sheets

STORAGE STRUCTURE FOR TEXTILE BOBBINS

This application is a continuation, of application Ser. No. 07/095,153, filed Sept. 25, 1987 now abandoned.

The present invention concerns a storage structure for yarn bobbins, which is particularly suitable for large dimension bobbins and for storing bobbins produced by automatic pick up devices.

BACKGROUND ART

Yarn bobbin storage systems comprising movable deposit equipments or storage frameworks upon wheels and stationary storage units within the deposit equipments are already known. According to these known systems, the stationary storage units are manually loaded with the yarn bobbins and then the movable deposit is transported to the storehouse and, at a convenient time, to the palletizer where the final packaging of the bobbins occurs.

Nevertheless such a system has the disadvantage that the handling of the bobbins brings about a worsening of the textile quality and it is known that textile material is very delicate. In fact, the yarn bobbins are very heavy (10–15 KG.) and their direct handling brings necessarily about a compression of the yarn windings and, consequently, a disintegration of the bobbins, a breaking of the yarn, a dispersion of yarn around the storage area and, above all, an uncertainty about the quality of the produced bobbins.

Further, the weight of the bobbins itself brings about an excessive physical stress on the manpower. Furthermore, since generally the same pick up device produces different kinds of yarn, the above described storage system used up to now implies a lack of certitude, as consequence of the possibility of making confusion among different kinds of yarn produced, thus bringing about the need of frequent and elaborate checks, that require the weighing of a section of the yarn, which corresponds to lengthy measurements.

DISCLOSURE OF THE INVENTION

Accordingly, one object of the present invention consists of allowing the transportation and the storage of the yarn bobbins to occur just through a central supporting tubular member, avoiding in this way to apply any force to the yarn mass and preserving its quality.

Another object of the present invention is to allow the bobbins to be automatically transported and stored, reducing in this way the physical stress of the manpower.

Not last among the objects of the present invention is to allow the bobbins topology to be simply identified upon the basis of their location within the storehouse, thus avoiding the need for checks. These, and other objects, are reached by the present invention of a storage structure for yarn bobbins comprising a plurality of storage units, each of said units comprising cantilever projecting support means, which are suitable to engage the central tubular member of said yarn bobbins, characterized in that said storage units are arranged in a plurality of stationary deposit equipments; the storage units of each stationary deposit equipment being movable along an annular horizontal path within the stationary deposit equipment itself; said plurality of stationary deposit equipments being arranged in groups of one or more deposit equipments vertically superimposed; said groups of superimposed stationary deposit equipments being arranged in lateral, side-by-side relationship, thus defining with their ends a vertical surface of loading and a vertical surface of unloading; said loading vertical surface and said unloading vertical surface being accessible to loading and unloading means, respectively, both movable horizontally and vertically.

Said loading and unloading means comprising cantilever projecting loading and unloading units, which are suitable to engage the central tubular member of said yarn bobbins and transfer means, that are suitable to transfer said yarn bobbins from said loading means to said storage units and then from said storage units to said unloading means.

BRIEF DESCRIPTION OF THE DRAWINGS

The present invention will be better understood when reference is made to the drawings, which are enclosed as an illustration of an embodiment and not as a limitation of the invention, in which drawings.

WAYS OF CARRYING OUT THE INVENTION

Figure 1:
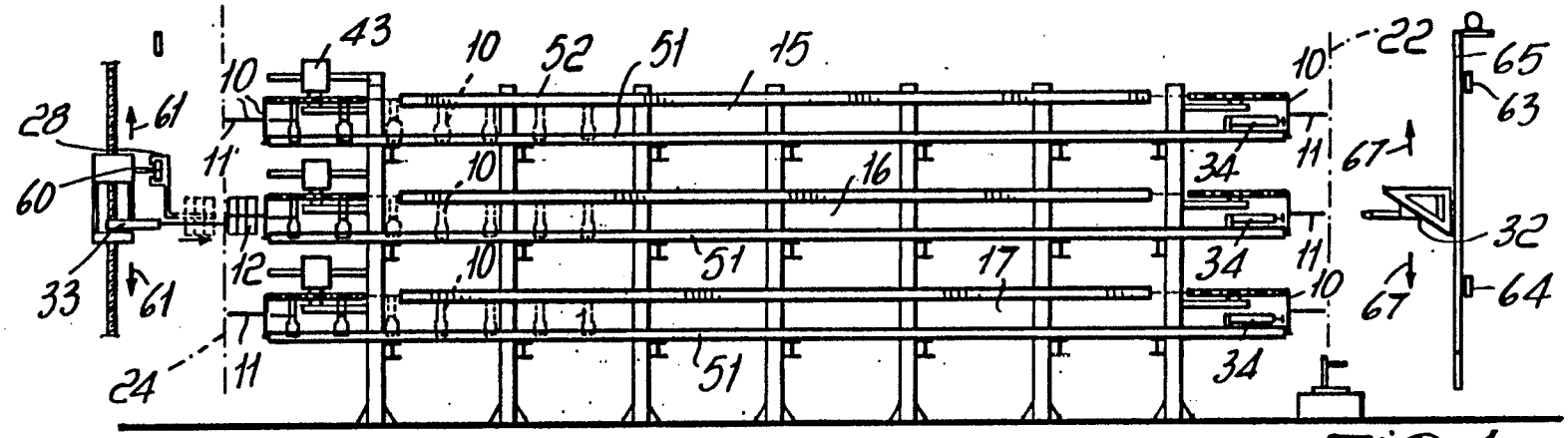
FIG. 1 is a lateral view of the storage structure, according to the invention.

With reference to FIG. 1 to 11, the storage structure for yarn bobbins 12 comprises a plurality of storage units 10; each unit 10 comprises support means 11, which are cantilever projecting and engaging the central tubular member of the bobbins 12.

The storage units 10 are set in a plurality of stationary deposit equipments 15, 16, 17. The storage units of each stationary deposit equipment are movable along an annular path within the equipment itself.

Figure 2:
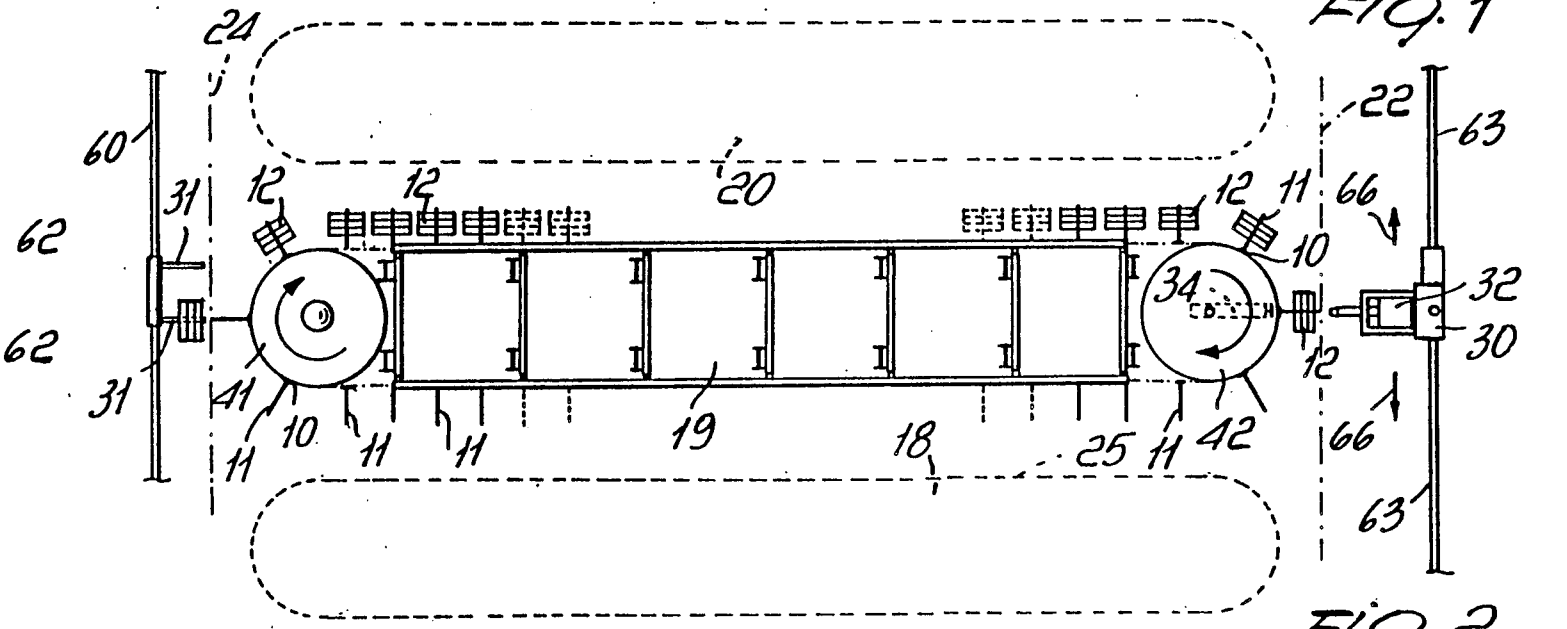
FIG. 2 is a view from the top of the structure shown in FIG. 1.
Figure 3:
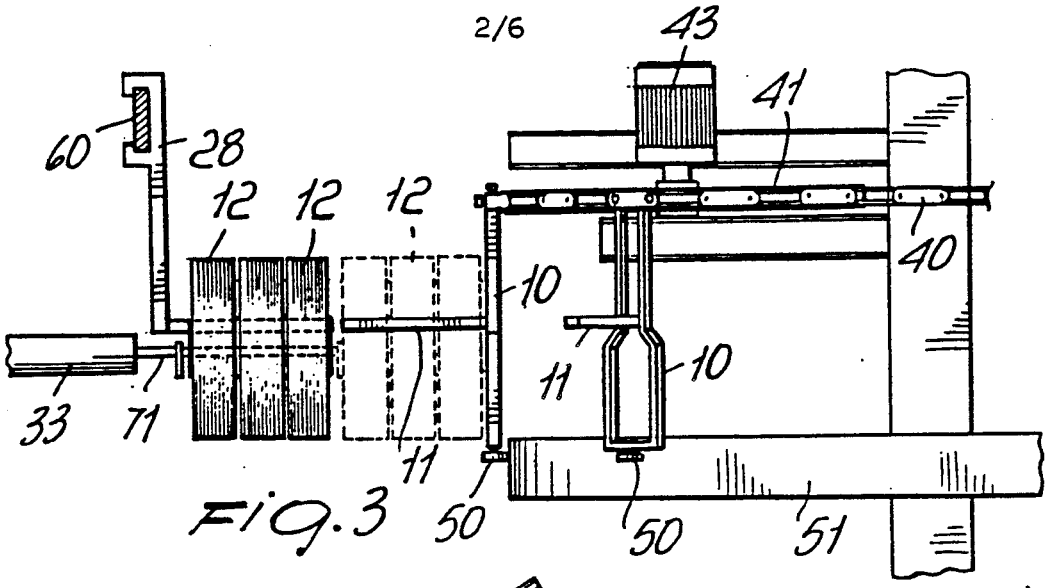
FIG. 3 is a lateral view of the loading means upon a storage unit.
Figure 4:
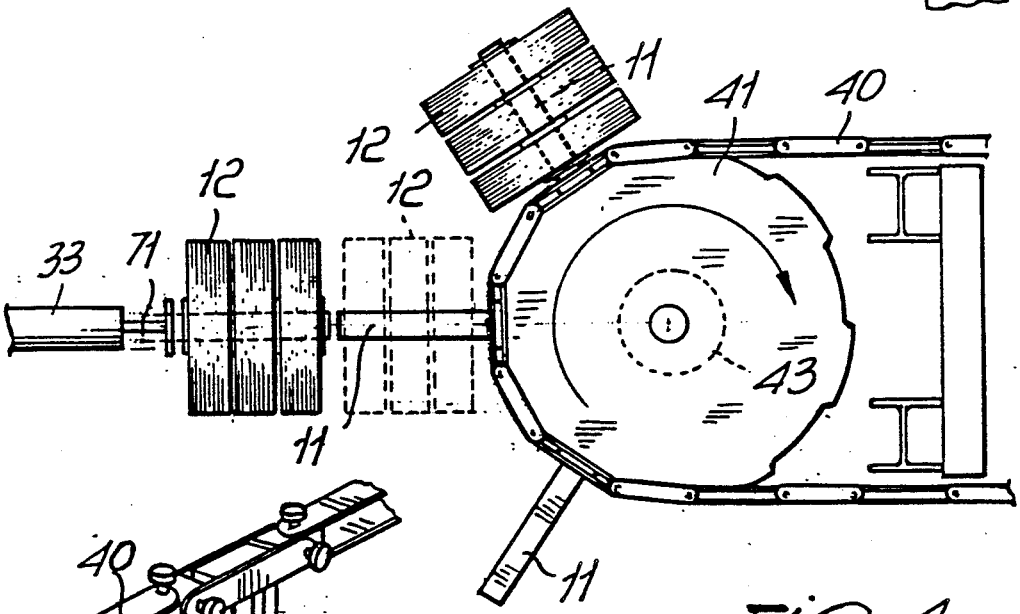
FIG. 4 is a top view of the loading means shown in picture 3.
Figure 5:
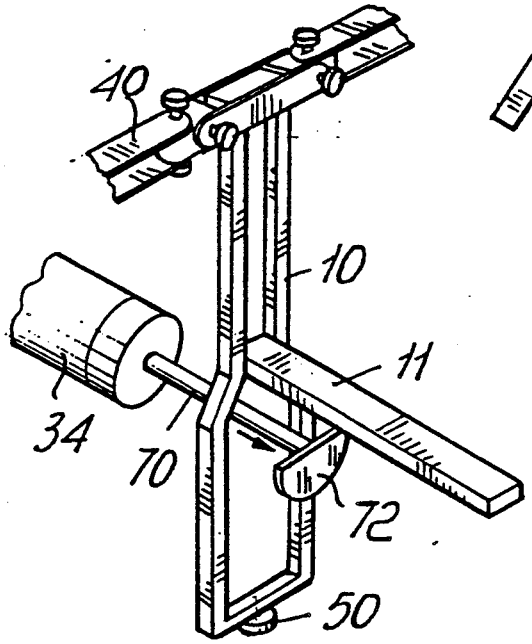
FIG. 5 is a perspective view of a storage unit and of transfer means.
Figure 6:
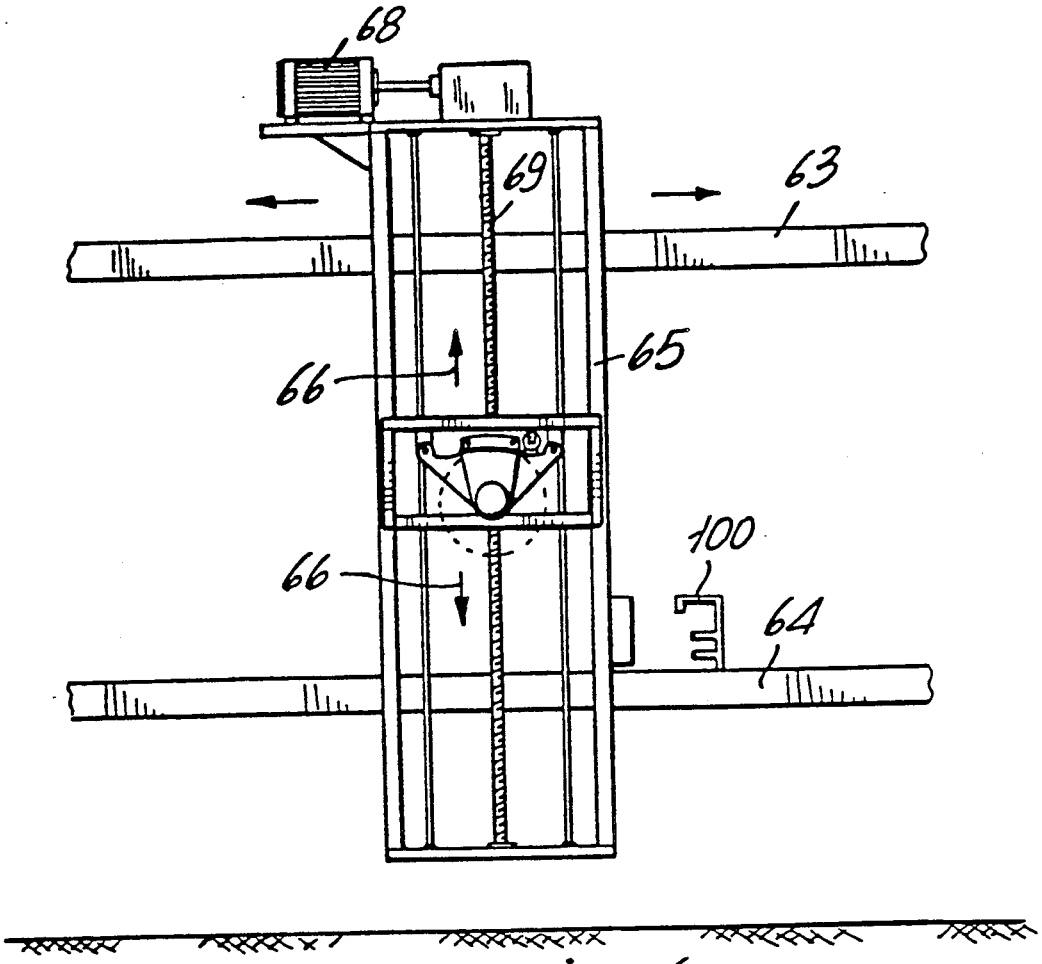
FIG. 6 is a front view of the unloading means.

The stationary deposit equipments are set in groups of one or more of such equipments, which are vertically superimposed. In the embodiments of FIG. 1 and 2 three groups 18, 19, 20 of stationary deposit equipments are shown, each group containing three equipments 15, 16, 17. Even if it is possible to use the groups 18, 19, 20, containing each one sole stationary deposit equipment, the embodiment having two or more superimposed stationary deposit equipments in each group 18, 19, 20, is to be preferred.

The groups of stationary equipments 18, 19, 20 are arranged in lateral, side-by-side, relationship and define a vertical loading surface 24 and a vertical unloading surface 22. Such loading and unloading surfaces are accessible from all the storage units 10 of all the stationary deposit equipments 15, 16, 17 of all the groups 18, 19, 20, through the rotation of the storage units 10 along the annular path 25.

The loading vertical surface 24 is further accessible from the horizontally and vertically movable load means 28. The unloading vertical surface 22 is further accessible from the horizontally and vertically movable unloading means 30. The loading means 28 comprise cantilever projecting loading units 31. The unloading means 30 comprise cantilever projecting unloading units 32.

Both the loading units 31 and the unloading units 32 engage the central tubular member of the bobbin 12.

Transfer means 33, suitable to transfer the bobbins 12 from the loading means 28 to the storage units 10 have also been foreseen. The same occurs with regard to transfer means 34 that are suitable to transfer the bobbins 12 from the storage units 10 to the unloading means 30.

According to the preferred embodiment, each of the stationary deposit equipments 18, 19, 20, comprises a horizontal annular chain 40, which is kept under tension by a driving gear 41 and by an idle gear 42. The driving gear is actuated by the motor 43.

The storage units 10 are fixed to the horizontal annular chain, so that the annular motion of the chain 40, actuated by the driving gear 41, brings about the movement of the storage units 10 along the annular path built by the chain 40.

Each storage unit comprises a bearing body 50, which is composed by a wheel suitable to slide horizontally upon an appropriate annular guide which builds substantially the same annular path 25 of the chain 40.

Each stationary deposit equipment 15, 16, 17 comprises an annular guide 51, which is integral with it.

Each annular chain 40 is supported for at least one step of the annular path by a horizontal guide 52 supporting the weight of the yarn bobbin 12.

The annular path 25 of each chain 40 has two opposite ends close to the loading means 28 and to the unloading means 30, respectively.

The ends of the cantilever projecting support means 11 of the storage units 10, set in correspondence with such opposite ends of the chain path, define the loading vertical surface 24 and the unloading vertical surface 22, respectively.

According to a preferred embodiment, such surfaces 22, 24 are plain ones. Such opposite ends of the annular path 25 are, thus, in correspondence with said gears 41, 42, which subtend the chain 40.

The loading means 28 comprise a horizontal track 60, which is vertically movable according to the arrows 61, parallel to the vertical loading surface 24.

The cantilever projecting loading units 31 are horizontally movable according to the arrows 62 and slide along the horizontal track 60.

The transfer means 33 comprise a movable piston 71, which is secured to the loading means 28.

The unloading means 30 comprise at least one stationary horizontal track 63 and preferably two stationary horizontal tracks 63 and 64.

The above mentioned tracks support a vertical guide 65, which is horizontally movable upon the tracks 63, 64 according to the arrows 66. The vertical guide 65 supports the cantilever projecting unloading units 32, allowing, in this way, their vertical motion to occur, according to the arrows 67. The vertical motion of the unloading units is actuated by the motor 68 through a worm screw 69.

Similarly, other peculiar motor-driven means are provided for the horizontal displacement of the vertical guide 65 along the track 63 and/or 64; such motored means have not been indicated in order to make the drawings more easily understandable but they are within the reach of a person skilled in the art.

The horizontal positioning of the vertical guide 65 in front of each group 18, 19, 20 is obtained through jig locator bodies 100 exciting an appropriate sensor, which is integral with the guide 65.

Similarly the vertical positioning of the unloading units 32 in front of each deposit 15, 16, 17 is reached through jig locator bodies, which are integral with each stationary deposit equipment and are able to excite proper sensors In a similar way it is further reached, through the use of sensors, the horizontal positioning of the loading units 31 in front of each group 18, 19, 20 as well as the vertical positioning in front of each stationary deposit equipment 15, 16, 17.

The transfer means for the transfer of the bobbins 12 from the storage units 10 to the cantilever projecting unloading units 32 comprise a piston 70, which is movable in a horizontal direction and which is secured to each stationary deposit equipment 15, 16, 17.

The ends of the movable pistons 70 and 71, which are used for the transfer of the bobbins during the loading phase and during the unloading phase, respectively, have, at their ends, a vertical flat part 72, whose excursion is larger than the diameter of the central tubular member of the yarn bobbins 12. Mostly, such flat part 72 has the shape of a semicircle. It has been noticed that the width of such flat part 72 is an important factor which ensures the reliability of the transfer of the bobbins. As a matter of fact, and surprisingly, if the width of the part 72 is smaller than the diameter of the central tubular member interruptions occur during the transfer.

The cantilever projecting unloading unit 32 comprises a cantilever projecting horizontal rod 75, which is horizontally movable in a direction that is perpendicular to the vertical unloading surface 22, according to the arrow 76.

Thus, by considering the motions and constraints of the horizontal rod, the following can be noticed:

the unloading unit 32 supporting the rod 75 is forced to move along a vertical surface, which is preferably a vertical plane defined by the track 63 together with the vertical guide 65 and such plane is parallel to the vertical plane unloading surface 22, defined by the groups of superimposed deposits 18, 19, 20. Besides, the horizontal rod 75 is forced to move in a direction that is perpendicular to these two planes which are parallel between them (the vertical unloading plane 22 and the vertical plane of the track 63 and of the guide 65).

Such motion in a perpendicular direction is driven by the piston 80. Particularly in FIG. 8 the operation of transfer of the bobbins from the storing unit 10 to the unloading units is shown, as well as the advancement of the rod 75 in a direction that is perpendicular to the surface 22.

Figure 9:
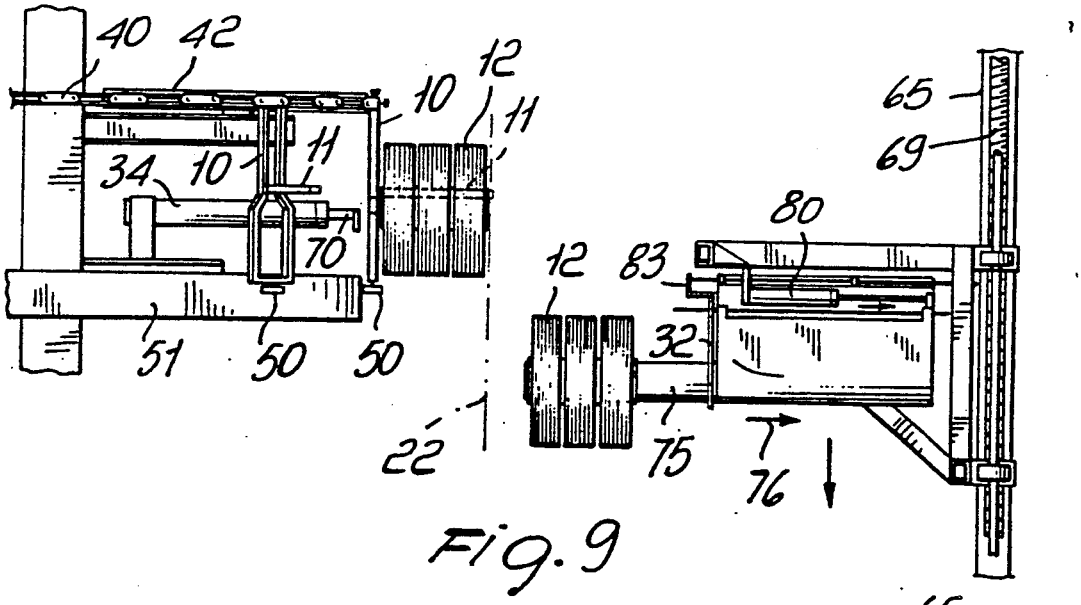
FIG. 9 is a lateral view illustrating the vertical movement of the loading units.

With particular regard to FIG. 9 the operation of the back motion of the rod 75 in a direction that is perpendicular to the surface 22 is shown, as well as the vertical displacement of the unloading units 32.

Figure 10:
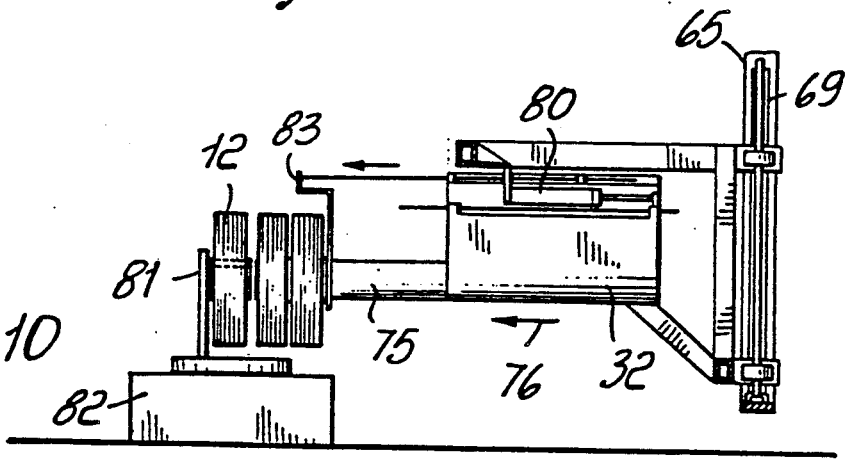
FIG. 10 is a lateral view illustrating the transfer of the yarn bobbins towards the transport means.

With particular regard to FIG. 10 the operation of the transfer of the bobbins 12 from the unloading unit 32 to those transport means comprising a transport unit 81 and a conveyor belt 82 is shown it is further shown the operation of the advancement of the rod in a direction that is perpendicular to the surface 22.

Figure 7:
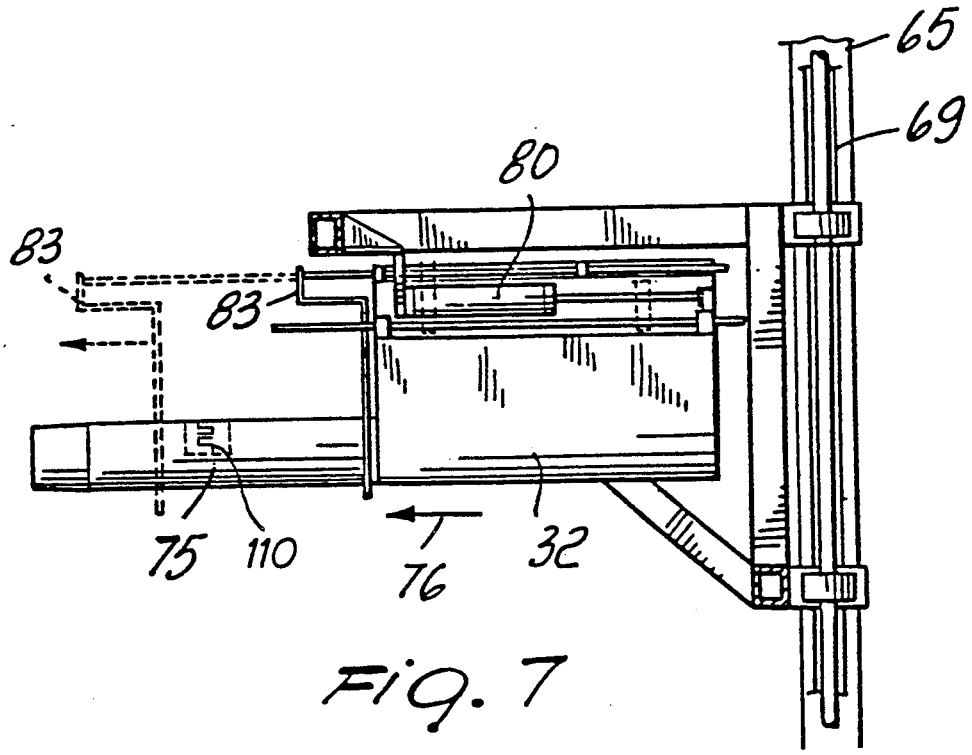
FIG. 7 is a lateral view of the unloading units.
Figure 8:
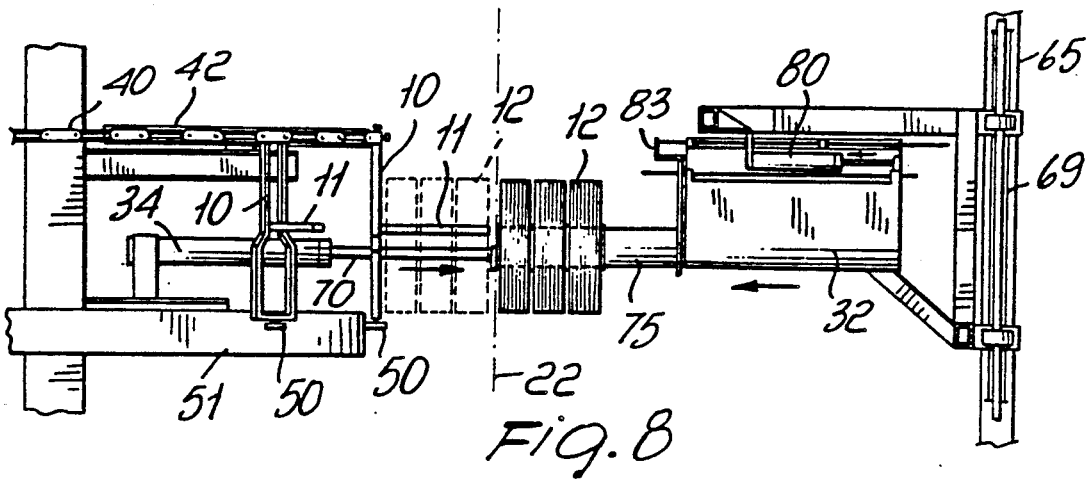
FIG. 8 is a lateral view illustrating the transfer of the bobbins from the storage units to the unloading units.

With particular regard to FIG. 7, 10, 11 the unloading unit 32 comprises a thrust body 83 for the transfer of each yarn bobbin 12 one at a time to the transport means 81, 82. The thrust body 83 is actioned by a piston.

Figure 11:
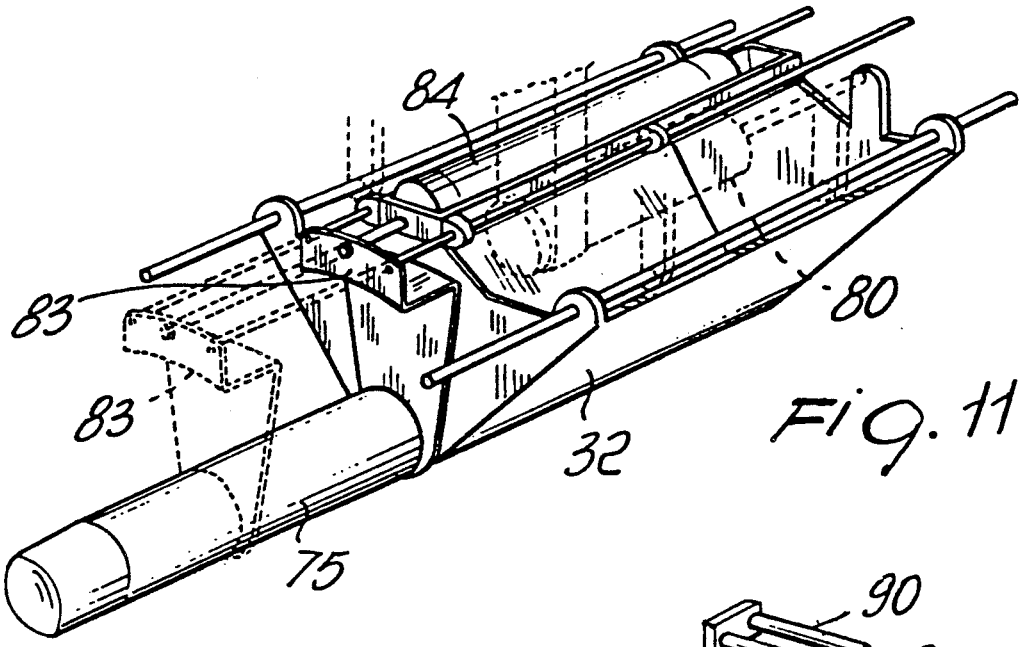
FIG. 11 is a perspective view of an unloading unit.
Figure 12:
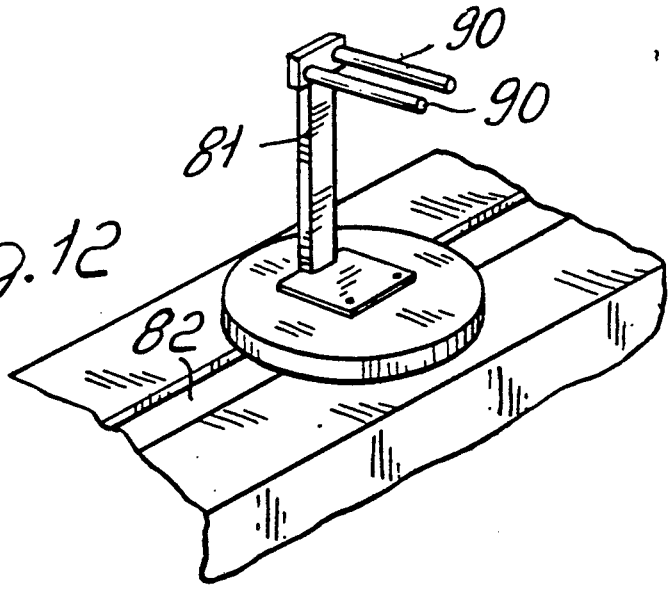
FIG. 12 is a perspective view of the conveyor belt and of the transport units transporting the yarn bobbins.
Figure 13:
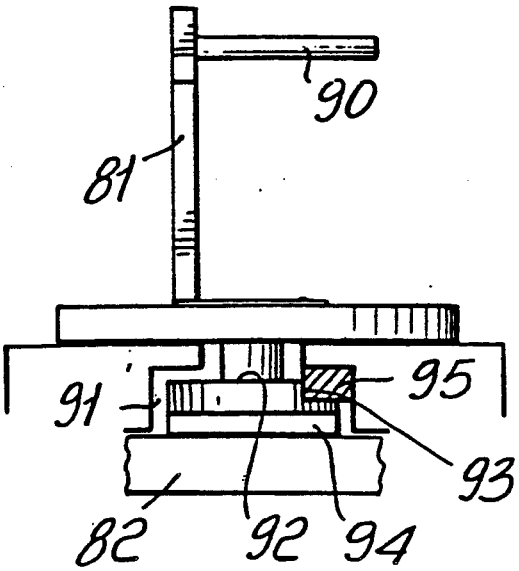
FIG. 13 shows, partly in view and partly in cross section, the conveyor belt which engages one transport unit.
Figure 14:
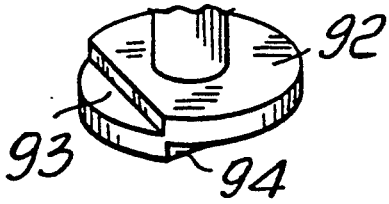
FIG. 14 is a perspective view of the transport unit slot, illustrated in FIG. 13.

The dotted line FIG. 11 shows an advancement position of the thrust body 83.

In order to unload the bobbins 12, one at a time, upon different transport units 81, more advanced positions of the thrust body 83 have been provided for, i.e. one for each bobbin 12; so that the rod 75 engages the tubular members of three bobbins 12, the first advancement position of the thrust body 83 allows the first bobbin to be transferred on a transport unit 81, as shown in FIG. 10, the second advancement position of the thrust body 83 allows the second bobbin to be transferred on another unit 81 and so, similarly, the third position of the body 83 allows the third bobbin to be transferred on a third transport unit 81.

Preferably, the free end of the rod 75 sags under the weight of the yarn bobbin that, one at a time, is placed on such end. The rod end 75 comprises a measure element (shown schematically in FIG. 7) formed, for example, by a flexible, variable resistance, which allows to measure the weight of the bobbins one at a time at a location which is in proximity to such end.

The weight of such bobbins can be memorized by a computer.

The transport means 81 and 82 comprise a conveyor belt 82 and a plurality of transport units 81. Each transport unit 81 has at least one cantilever projecting element 90 and, preferably, two cantilever projecting elements 90. It has been noticed that the presence of two elements 90 allows the transported bobbins to be proportionately stabilized. The elements 90 are suitable to support the bobbins 12 through a central tubular member.

The base 92 of the transport unit 81 is suitable to engage a channel 91 situated immediately above the conveyor belt 82.

The base 92 has a groove 93, which is suitable to engage a corresponding engaging member 95, which is secured to the belt guide 82, in order to keep the transport unit 81 oriented in a predetermined direction, as compared to the direction of the conveyor belt 82.

The engaging member 95 is situated in that part of the conveyor belt 82 which is indicated in FIG. 10 in order to keep the transport unit directed towards the rod 75 and, thus, allowing the transfer of the bobbins.

In other parts of the conveyor belt 82 and, in particular, in the corners, the engaging member is not used in order to have a better handling possibility of the transport unit, which is free to rotate around 360°.

According to one preferred embodiment the base 92 of the transport unit has a second groove 94, which is suitable to engage another corresponding engaging member, which is secured to the belt guide 82, in order to orient .the transport unit 82 in another predetermined direction.

Such second guidance of the transport unit 81 is used in subsequent yarn checking operations, for which it is important to receive the bobbins (in a condition where they are already) oriented in other directions.

Figure 15:
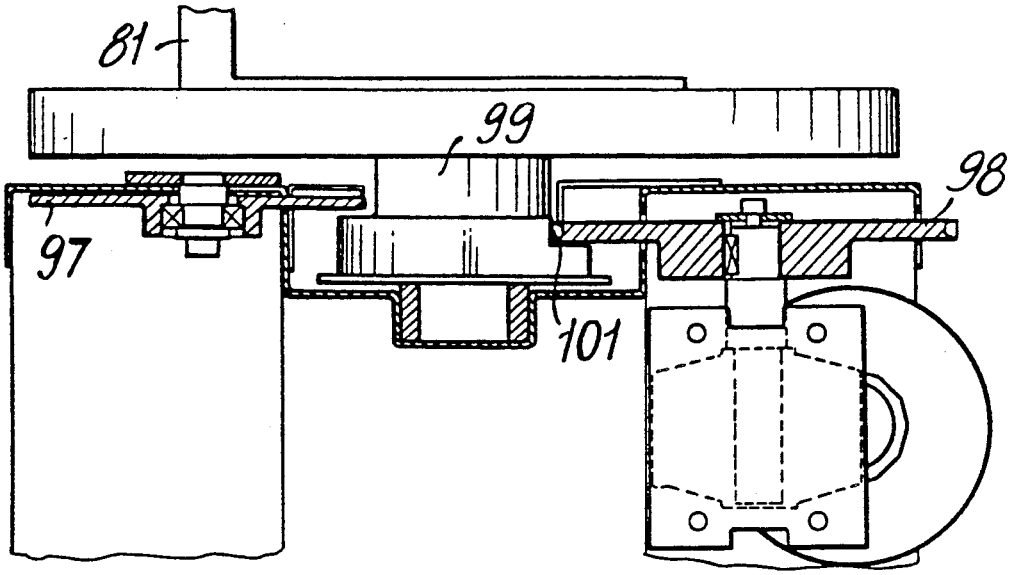
FIG. 15 is a lateral view of the insertion means of the transport units within their location.
Figure 16:
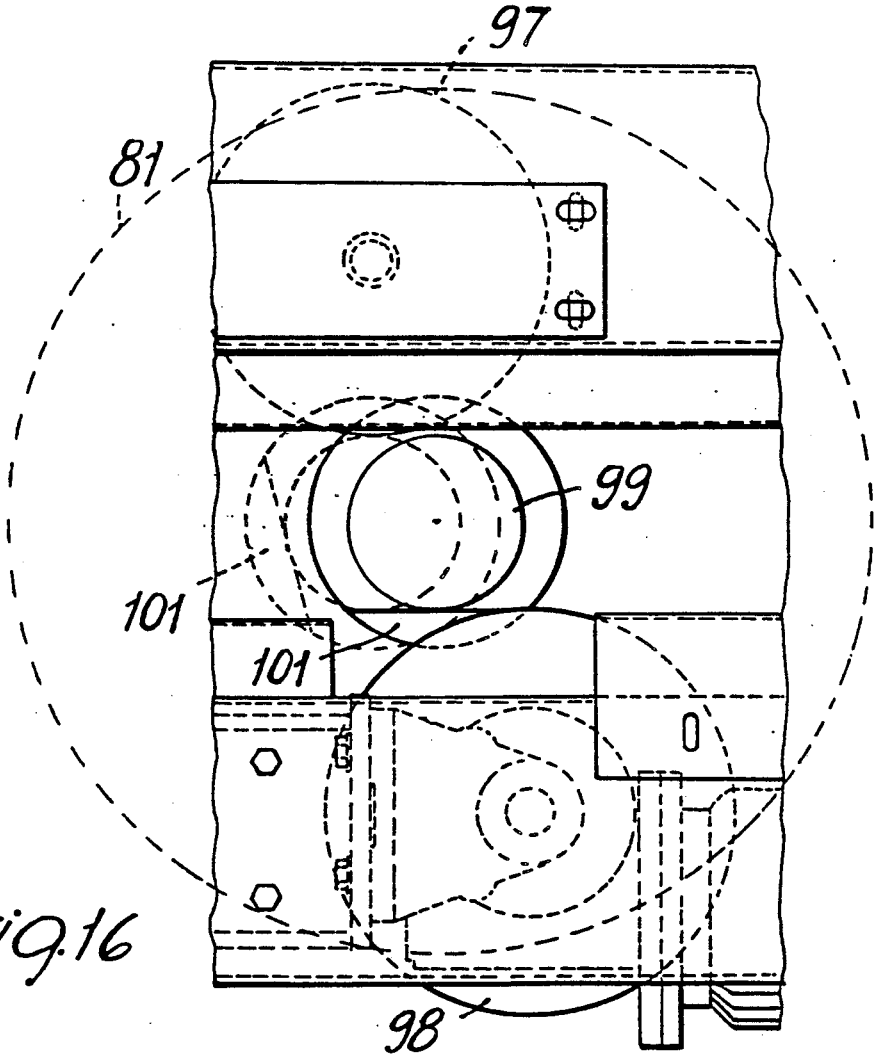
FIG. 16 is a top view of the insert means referred to in FIG. 15.

With reference to FIG. 15 and 16, insert means of the transport unit 81 for their positioning into their seats, are provided, so that the groove 93 engages the corresponding engaging member 95.

Such insert means comprise an idle wheel 97 and a driving wheel 98. Both the wheels 97 and 98 are rotable around a vertical axis.

The idle wheel 97 is set at such a high position as to engage the parallel support 99 of the transport unit 81. The driving wheel 98 is set at such a high position as to engage the base 92 on a level with the groove 101, so that the rotation of the driving wheel 98, together with that of the idle wheel 97, produces the rotation of the transport unit 81 around its own vertical axis until the driving wheel 98 engages the groove 101, thus producing the insertion of the transport unit into its own seat.

Alternatively, the weighing phases can be performed during the loading into the storage means with a system that is similar to the one described in relation to the rod end 75. According to this embodiment, the information about the weight of each bobbin can be memorized by a checking and control computer, together with any information regarding the position of each bobbin in the storage mean and those regarding the kind of yarn.

The central computer can, then, operate the resettling of the storehouse during the rest phases, when neither loading, nor unloading is occurring, such resettling comprises, for example, the grouping within the same area of similar bobbins, which have the same characteristics, so that, when the need to unload a certain kind of yarn occurs, all the corresponding bobbins having the same weight, are all gathered in the same area and the unloading appears to be much easier and fast.

Similarly, the resettling of the storehouse allows the dead areas to be eliminated and all the available space to be correctly exploited.

In practice it has been found that the structure here described allow$ the bobbins 12 to be automatically stored through the loading units 31, the storage units 10, the unloading units 32 and the transport units 81, which all support the yarn bobbins 12 only through the central tubular member, thus avoiding any damaging of the yarn as well as any physical stress affecting the manpower.

Further the automation of the positions of the bobbins within the various treatment units, gives the opportunity to find out with certainty which is the kind of yarn which is available at a certain time in a certain unit, thus avoiding mistakes and their consequent checking needs.

We claim:

1. A structure for storing yarn bobbins comprising a plurality of storage units, each of said storage units comprising cantilever projecting support means suitable to engage the central tubular member of said yarn bobbins, characterized in that these said storage units are arranged in a plurality of stationary storage frameworks means to move each storage unit of each stationary storage framework about the stationary storage framework itself along a horizontal annular path, said plurality of stationary storage frameworks being arranged so that at least one stationary storage framework is vertically superimposed over another in a spaced-apart relationship; said superimposed stationary storage frameworks having storage units arranged in a lateral, side-by-side, relationship along each of said storage frameworks each of said stationary storage frameworks defining with its opposite ends a vertical loading surface and a vertical unloading surface; said loading surface and said unloading surface being accessible from horizontally and vertically movable loading means, respectively, said loading means and said unloading means comprising cantilever projecting loading units and unloading units, which are suitable to engage the central tubular member of said yarn bobbins and transfer means suitable to transfer the yarn bobbins from said loading units to said storage units and from said storage units to said unloading units; said transfer means including a moving conveyor belt and plurality of transport units, each of said transport units including at least one cantilever projecting element to support one of said yarn bobbins.

2. A structure, according to claim 1, in which each of said stationary deposit equipment comprises a horizontal annular chain which is guided around a driving wheel and by an idle wheel, said storage units being secured to said horizontal chain.

3. A structure, according to claim 2, in which each of said units comprises a bearing body arranged for sliding along an annular guide in turn arranged on each stationary deposit equipment.

4. A structure, according to claim 1, in which said horizontal, annular chain is supported by a horizontal guide, which carries the weight of said yarn bobbins.

5. A structure, according to claim 1, in which said loading means comprise a horizontal track which is vertically movable and is parallel to the vertical loading surface; said cantilever projecting loading units being horizontally movable on said track; said transfer means of said yarn bobbins from said cantilever projecting loading units to said storage units comprising a piston, which is secured to said loading means.

6. A structure, according to claim 1 in which said unloading means comprise at least one stationary horizontal trade supporting a vertical guide, arranged for movement in a horizontal direction along said stationary horizontal track, said vertical guide supporting said cantilever projecting unloading units, arranged for vertical movement on said vertical guide; said transfer means of said yarn bobbins from said storage units to said cantilever projecting unloading units, comprising a piston which is arranged for movement along a horizontal path and is secured to each stationary storage framework.

7. A structure, according to claim 6, in which the ends of said movable piston has a vertical flat section, the width of which is larger than the diameter of said central tubular member of said yarn bobbins.

8. A structure, according to claim 6, in which said cantilever projecting unloading units comprise a cantilever horizontal rod, which is horizontally movable in a direction which is perpendicular to said vertical unloading surface.

9. A structure, according to claim 8, in which the end of said cantilever horizontal rod is arranged for sagging under the weight of the yarn bobbin situated in correspondence with said end, said end comprising measure means, suitable for measuring the weight of said yarn bobbin.

10. A structure, according to claim 6, in which said unloading unit comprises a thrust body for the transfer of each yarn bobbins to the transport means.

11. A structure, according to claim 1, in which the base of each of said transport units has at least one groove, which is suitable to engage a corresponding engaging member, which arranged for guiding said conveyor belt and said transport unit towards a predefined direction.

12. A structure, according to claim 11, in which the base of each of said transport units has two different off-set grooves suitable for engagement with two different, corresponding engaging members situated on the guide of said conveyor belt.

13. A structure, according to claim 11, wherein said transport units further comprise insert means for positioning into said seats, so that said groove engages said engaging member.

14. A structure, according to claim 13, characterized in that said insert means comprise an idle gear and a driving gear, both said gears being rotatable around a vertical axis, said idle gear engaging the parallel support of the transport units, said driving gear engaging the base of said transport units on a level with said groove.

15. An apparatus for storing yarn bobbins comprising:

a plurality of storage units, each comprising a cantilever suitable for engaging a central tubular member of said yarn bobbin, said cantilever comprising a rod of length sufficient to engage a plurality of said tubular members simultaneously, said plurality of storage units disposed on each of a plurality of conveyor belts, each conveyor, belt comprising a continuous, annular loop, said plurality of conveyor belts arranged in vertical columns and horizontal rows such that said conveyor belts have first ends which define a vertical loading plane and second ends which define a vertical unloading plane, means for moving said conveyor belts through said annular loop, loading means and unloading means, each comprising a cantilever for engaging said central tubular member of said yarn bobbins and means for movably positioning said loading means and unloading means into mating position with any of said storage means, and transfer means for transferring said yarn bobbins from said loading units to said storage units and from said storage units to said unloading means; said transfer means including a moving conveyor belt and a plurality of transport units, each of said transport units including at least one cantilever projecting element to support one of said yarn bobbins.

16. An apparatus as set forth in claim 15 wherein said transfer means of each said loading or unloading means comprises, a piston positioned parallel and adjacent to said cantilever of said loading or unloading means, said piston having an enlarged flat end for contacting said yarn bobbins, and means for selectively driving said piston to push said yarn bobbins out of engagement with said cantilever.

17. An apparatus as set forth in claim 16 wherein said means for movably positioning said loading means and unloading means each comprises a horizontal track vertically movable and parallel to the vertical loading plane, said cantilever of said loading means and unloading means being horizontally movable on said horizontal track.

18. An apparatus as set forth in claim 17 wherein each of said plurality of conveyor belts comprises a horizontal annular chain guided around a driving wheel and an idle wheel, said storage units being secured to said horizontal chain.

* * * * *